US008393722B2

(12) United States Patent
Sakurai

(10) Patent No.: US 8,393,722 B2
(45) Date of Patent: Mar. 12, 2013

(54) SET OF CARTRIDGES AND PRINTER

(75) Inventor: Hisaki Sakurai, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 77 days.

(21) Appl. No.: 13/052,242

(22) Filed: Mar. 21, 2011

(65) Prior Publication Data

US 2011/0234717 A1 Sep. 29, 2011

(30) Foreign Application Priority Data

Mar. 24, 2010 (JP) ..... 2010-068396

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 5,757,390 A * 5/1998 Gragg et al. ..... 347/7
6,322,205 B1 * 11/2001 Childers et al. ..... 347/85
7,318,640 B2 * 1/2008 Hattori et al. ..... 347/86
7,350,909 B2 * 4/2008 Takagi et al. ..... 347/86
7,357,494 B2 * 4/2008 Katayama et al. ..... 347/86
2009/0179926 A1 * 7/2009 Sugahara ..... 347/7
2009/0201347 A1 * 8/2009 Hamano ..... 347/85

FOREIGN PATENT DOCUMENTS

JP 2005-246781 A 9/2005

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A set of cartridges includes a first cartridge including a first tank, wherein a liquid level in the first tank is at a first position when an amount of liquid stored in the first tank is a predetermined amount, and a second cartridge including a second tank, wherein a liquid level in the second tank is at a second position which is below the first position when an amount of liquid stored in the second tank is the predetermined amount. The first cartridge is configured such that a light-blocking portion moves out of a detection region when the liquid level in the first tank lowers and reaches the first position, and the second cartridge is configured such that a light-blocking portion moves out of the detection region when the liquid level in the second tank lowers and reaches the second position.

9 Claims, 10 Drawing Sheets

SET OF CARTRIDGES AND PRINTER

CROSS REFERENCE TO RELATED APPLICATION

The present application claims priority to and the benefit of Japanese Patent Application No. 2010-068396, which was filed on Mar. 24, 2010, the disclosure of which is incorporated herein by reference in its entirety.

BACKGROUND OF THE INVENTION

1. Field of the Invention

The present invention relates to a set of cartridges having different capacities and a printer comprising the set of cartridges and a printer main body.

2. Description of Related Art

A known ink-jet printer, such as a printer described in JP-A-2005-246781, has a printer main body and cartridges having tanks for storing ink, and the cartridges are configured to be mounted to the printer main body. The printer is configured to form images on a sheet of paper with ink supplied from the cartridges. The printer has an ink amount detection mechanism for detecting an amount of ink stored in the cartridge. The printer is configured to notify a user when the amount of ink becomes little.

The cartridge has a shutter mechanism having a light-blocking panel configured to move up and down based on the change of ink level in the tank. The printer main body has an optical sensor having a light-emitting portion and a light-receiving portion at a predetermined position. When the amount of ink stored in the tank of the cartridge is large, the light-blocking panel is positioned between the light-emitting portion and the light-receiving portion and an optical signal emitted from the light-emitting portion toward the light-receiving portion is blocked by the light-blocking panel. In contrast, when the amount of ink stored in the tank is reduced and the ink level is lowered to a predetermined height, the light-blocking pane moves out of a space between the light-emitting portion and the light-receiving portion, such that the optical signal emitted from the light-emitting portion reaches the light-receiving portion. Therefore, the fact that the amount of ink is reduced to a predetermined amount, i.e., a near-empty state of the tank, can be detected by the light-receiving portion receiving the optical signal emitted from the light-emitting portion.

The amount of ink stored in the tank after the near-empty state of the tank is detected is estimated by a controller in the printer main body performing a "soft count" of an amount of used ink (an amount of ink discharged from an ink-jet head), i.e., by the controller counting the amount of ink discharged from the ink-jet head with a software. Accordingly, the printer can encourage a user to replace the cartridge with a new one before the amount of ink stored in the tank becomes completely zero.

An amount of ink consumption of the printer is different between a printer for home use and a printer for business use. Therefore, a printer which allows selective use of cartridges different in ink-storage capacity is desired. To meet this demand, the known printer, such as a printer described in JP-A-2005-246781, has a small-capacity cartridge and a large-capacity cartridge which can be selectively mounted to a holder of the printer main body. The above-described shutter mechanisms of the respective cartridges having different capacities have the same structure.

Because the shutter mechanisms of the cartridges having different capacities have the same structure, the near-empty state of the tank is detected when the ink level in the each tank reaches the same predetermined level irrespective of the difference in capacity of the cartridge. In this case, because of the difference in capacity among the respective cartridges, i.e., the difference in shape and size of the tank, the amount of ink when the tank in the large-capacity cartridge is detected to be in the near-empty state is greater than the amount of ink when the tank in the small-capacity cartridge is detected to be in the near-empty state. If the amount of ink is large when the tank is detected to be in the near-empty state, an error in the estimation of the amount of ink by the subsequent soft count becomes disadvantageously large.

SUMMARY OF THE INVENTION

Therefore, a need has arisen for sets of cartridges and a printer which overcome these and other shortcomings of the related art. A technical advantage of the invention is that an amount of ink stored in a tank of a cartridge having a smaller capacity when a near-empty state of the tank is detected is substantially equal to an amount of ink stored in a tank of a cartridge having a larger capacity when a near-empty state of the tank is detected.

In an embodiment of the invention, a set of cartridges comprises a first cartridge having a small capacity and comprising a first tank configured to store liquid therein, wherein a liquid level in the first tank is at a first position when an amount of liquid stored in the first tank is a predetermined amount, and a second cartridge having a large capacity and comprising a second tank configured to store liquid therein, wherein the second tank has a larger capacity than the tank of the first cartridge, and a liquid level in the second tank is at a second position which is below the first position. When an amount of liquid stored in the second tank is the predetermined amount. Each of the first cartridge and the second cartridge comprises a detection region configured to receive an optical signal emitted from an exterior of the first tank or the second tank. The detection region of the first cartridge is positioned at a same height as the detection region of the second cartridge. Each of the first cartridge and the second cartridge also comprises a float positioned in the first tank or the second tank, and configured to move based on the amount of liquid stored in the first tank or the second tank, and a light-blocking portion connected to the float and configured to move relative to the detection region based on a movement of the float. The light-blocking portion is configured to block the optical signal when the light-blocking portion is in the detection region and the optical signal is allowed to pass through the detection region when the light-blocking portion is out of the detection region. The first cartridge is configured such that the light-blocking portion moves out of the detection region when the liquid level in the first tank lowers and reaches the first position, and the second cartridge is configured such that the light-blocking portion moves out of the detection region when the liquid level in the second tank lowers and reaches the second position.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-10D, like numerals being used for like corresponding parts in the various drawings.

Figure 1:
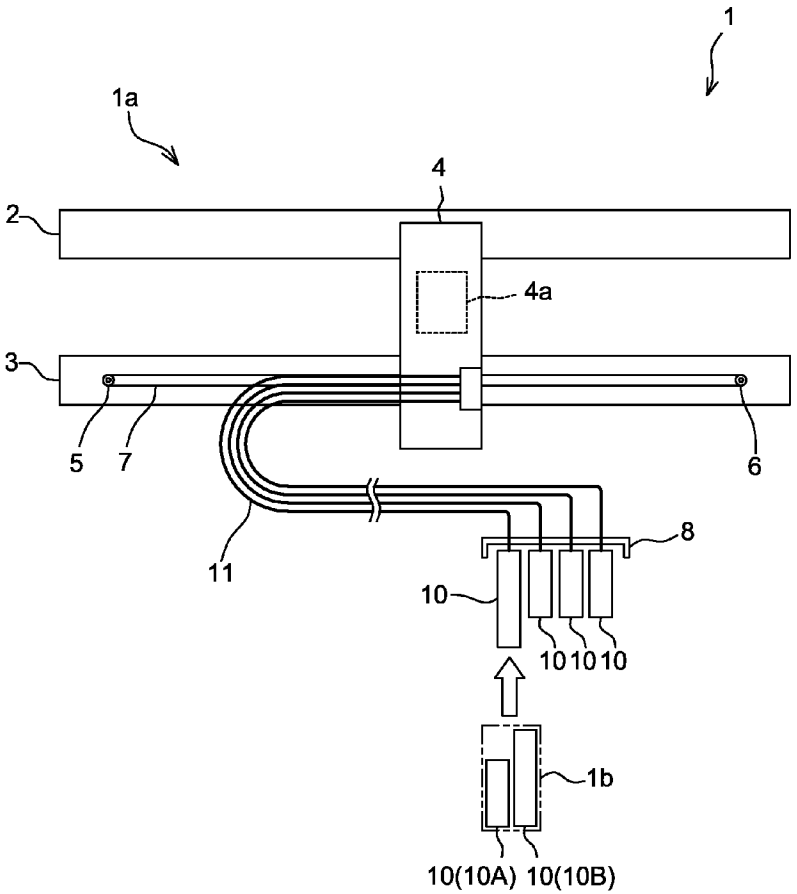
FIG. 1 is a schematic plan view of a main portion of a printer according to a first embodiment of the invention.

Referring to FIG. 1, a printer 1 comprises a printer main body 1*a* and a set of cartridges 1*b* comprising a plurality of ink cartridges 10. More specifically, the printer 1 comprises the plurality of ink cartridges 10 containing inks in black, cyan, magenta, and, yellow, respectively, and the two types of ink cartridges 10, i.e., a small-capacity cartridge 10A and a large-capacity cartridge 10B are provided as the set of cartridges 1*b* for the ink cartridge 10 containing ink in each color. The printer main body 1*a* comprises a pair of guide rails 2 and 3 extending substantially parallel to each other, and the guide rails 2 and 3 support a liquid discharging unit 4 so as to be slidable in the longitudinal direction (scanning direction) of the guide rails 2 and 3. A pair of pulleys 5 and 6 are provided in the vicinity of left and right ends of the guide rail 3, respectively, and the liquid discharging unit 4 is connected to a timing belt 7 wound around the pulleys 5 and 6. The pulley 6 is coupled to a motor (not shown) which is configured to rotate in normal and reverse directions, and the timing belt 7 can be moved reciprocally leftward and rightward in association with the rotation of the pulley 6 in the normal and reverse directions. Accordingly, the liquid discharging unit 4 is moved leftward and rightward along the guide rails 2 and 3.

The printer main body 1*a* comprises a cartridge mounting portion 8, and the ink cartridges (hereinafter, referred to as "cartridges") 10 of the sets of cartridges 1*b* are mounted to the cartridge mounting portion 8, such that the ink cartridges 10 are insertable and removable into/from the cartridge mounting portion 8 in a horizontal direction for replacement. The cartridge mounting portion 8 is configured to selectively receive the plurality of cartridges 10 having different capacities, i.e., the small-capacity cartridge 10A and the large-capacity cartridge 10B. Flexible ink supply tubes 11, as ink supply paths, are connected to the cartridge mounting portion 8 for supplying inks (for example, black, cyan, magenta, and yellow inks) from the cartridges 10 to the liquid discharging unit 4, respectively. A liquid discharging head 4*a* is mounted on a lower portion of the liquid discharging unit 4 and is configured to discharge ink (liquid) front the liquid discharging head 4*a* toward a printing medium (for example, a sheet of paper) transported in a direction perpendicular to the scanning direction below the liquid discharging head 4*a* and thereby form an image on the printing medium.

Figure 2A:
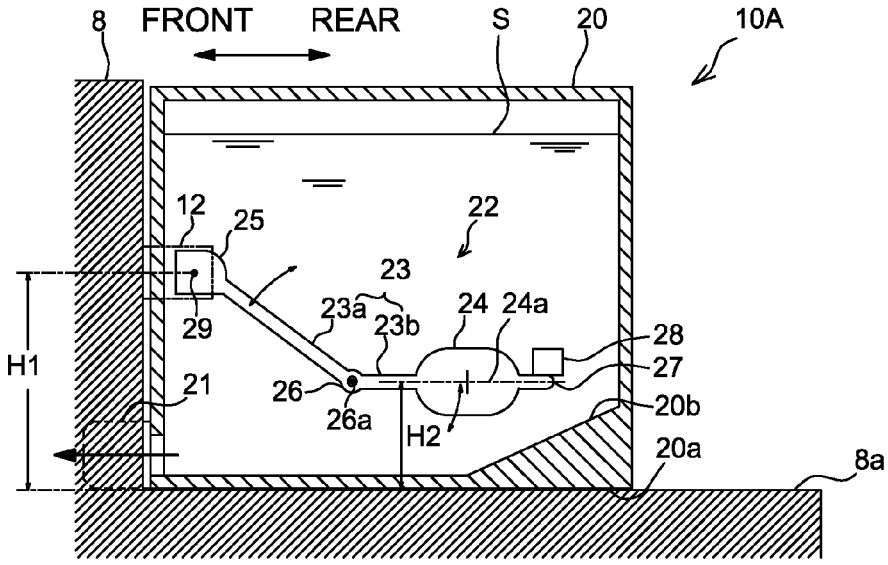
FIG. 2A is a cross-sectional side view of a small-capacity cartridge of a set of cartridges, which is mounted in a cartridge mounting portion, according to the first embodiment.
Figure 2B:
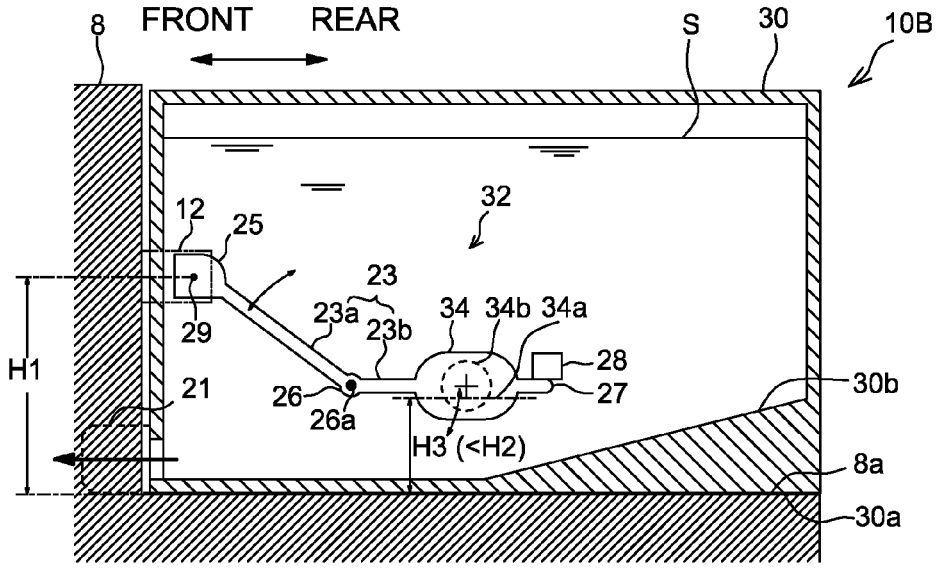
FIG. 2B is a cross-sectional side view of a large-capacity cartridge of the set of cartridges, which is mounted in the cartridge mounting portion, according to the first embodiment of the invention.

Referring to FIGS. 2A and 2B, the direction in which the cartridge 10 moves when the cartridge 10 is inserted into the cartridge mounting portion 8 is referred to as "front" and the direction in which the cartridge 10 moves when the cartridge 10 is removed from the cartridge mounting portion 8 is referred to as "rear".

Referring to FIG. 2A, the small-capacity cartridge 10A according to a first embodiment, comprises a tank 20 made of synthetic resin having a rectangular shape in side view, and the tank 20 is almost fully filled with ink in FIG. 2A. The ink cartridge 10A comprises an ink supply unit 21 positioned at a lower front end of the tank 20, and the ink stored in the tank 20 can be supplied to the exterior of the tank 20 via the ink supply unit 21. In contrast, the cartridge mounting portion 8 has a configuration which allows the ink cartridges 10 (10A, 10B) to be selectively mounted therein. Referring to FIG. 2A, when the cartridge 10A is mounted in the cartridge mounting portion 8, an outer bottom surface 20*a* of the tank 20 contacts and is supported by an inner bottom surface 8*a* of the cartridge mounting portion 8 from below. The bottom surface 8*a* of the cartridge mounting portion 8 is a substantially horizontal planar surface.

Ink extract portions (not shown) communicating with the ink supply tubes 11, respectively, are provided on a lower portion of a front inner end of the cartridge mounting portion 8. When the cartridge 10A is mounted in the cartridge mounting portion 8, the ink supply unit 21 and the ink extract portion are connected, such that the ink stored in the tank 20 is allowed to be supplied to the liquid discharging head 4*a* via the ink supply tube 11, as an ink supply path. The tank 20 comprises an inclined surface 20*b* positioned at a rear portion of an inner bottom surface of the tank 20, and the inclined surface 20*b* is inclined downward and toward the front side of the tank 20, such that the ink flows toward the front side of the tank 20 along the inclined surface 20*b* and reaches the ink supply unit 21 even when a remaining amount of ink stored in the tank 20 is reduced.

The cartridge 10A comprises a shutter mechanism 22 positioned in the tank 20. The shutter mechanism 22 comprises an arm 23, and a float 24 and a light-blocking portion 25 provided at both ends of the arm 23, respectively. The arm 23 comprises a pivot portion 26 between the float 24 and the light-blocking portion 25, and has a bent shape bent at the pivot portion 26. More specifically, in the state shown in FIG. 2A, the arm 23 comprises a front arm 23*a* extending from the pivot portion 26 obliquely upward toward the front side of the tank 20 and a rear arm 23*b* extending rearward from the pivot portion 26 toward the rear side of the tank 20. The pivot portion 26 is pivotably supported by the tank 20, such that the arm 23 is pivotable about a pivot point 26*a* located at a center of the pivot portion 26.

The float 24 is provided at a rear end of the rear arm 23*b* and is made of a material having a smaller specific gravity than that of the ink stored in the tank 20. The arm 23 comprises a locking strip 27 projecting rearward from a rear end of the float 24, and the tank 20 comprises a stopper 28 configured to contact the locking strip 27 from above to restrict the upward movement of the float 24. As shown in FIG. 2A, when the tank 20 is almost full of ink, the float 24 is located below an ink level S and is entirely submerged in the ink. Therefore, the float 24 is urged upward by buoyancy and the locking strip 27 is stopped at an upper limit position contact with the stopper 28. In contrast, after the remaining amount of ink is reduced, and hence the ink level S lowers, such that a portion of the float is exposed from the ink level. S, the float 24 moves down together with the lowering of the ink level S.

The light-blocking portion 25 is provided at a front end of the front arm 23*a*, and configured to move up and down association with the upward and do movement of the float 24, i.e., in association with the displacement of the ink level S of ink in the tank 20. In the state shown in FIG. 2A, the light-blocking portion 25 is positioned in the vicinity of a front wall portion of the tank 20, and is positioned at a lower limit of the movable range. The cartridge 10A comprises a detection region 29, and the light-blocking portion 25 positioned at the lower limit is overlapped with the detection region 29 in side view. In other words, the light-blocking portion 25 positioned at the lower limit is overlapped with the detection region 29 in the width direction of the cartridge 10A, i.e., in a horizontal direction perpendicular to the front-rear direction.

The cartridge mounting portion 8 comprises an optical sensor 12 positioned at the front inner end of the cartridge mounting portion 8. The optical sensor 12 comprises a light-emitting portion and a light-receiving portion, and the light-emitting portion and the light-receiving portion are disposed so as to sandwich a front end portion of the tank 20 of the cartridge 10A mounted in the cartridge mounting portion 8 in the width direction of the cartridge 10A. The optical sensor 12 is configured to be driven on the basis of a control signal from a controller (not shown) of the printer main body 1*a*, and configured to emit an optical signal from the light-emitting portion toward the light-receiving portion (toward the direction vertical to the paper plane of FIG. 2). In other words, the optical sensor 12 emits the optical signals from the light-emitting portion toward the light-receiving portion in the width direction of the cartridge 10A.

At least a portion of the tank 20 corresponding to the optical sensor 12, i.e., a portion of the tank 20 positioned between the light-emitting portion and the light-receiving portion, is made of a translucent, e.g., transparent or semi-transparent material in a state in which the cartridge 10A is mounted in the cartridge mounting portion 8. Therefore, the optical signal emitted from the optical sensor 12 enter the tank 20 through the portion made of the translucent material. A region of the tank 20 where the optical signal passes corresponds to the detection region 29, and the detection region 29 is positioned at a predetermined height H1 from the outer bottom surface 20*a* of the tank 20.

As described above, the light-blocking portion 25 is configured to we up and down in association with the upward and downward movement of the float 24. More specifically, the light-blocking portion 25 is configured to move so as to enter and move out of the detection region 29. The light-blocking portion 25 shown in FIG. 2A is in the detection region 29, and the optical signal emitted from the light-emitting portion of the optical sensor 12 is blocked by the light-blocking portion 25, such that the optical signal cannot be received by the light-receiving portion. When the light-receiving portion of the optical sensor 12 does not receive the optical signal in this manner, more specifically, when the light-receiving portion of the optical sensor 12 receives the optical signal having an intensity less than a predetermined intensity, the printer main body 1*a* determines that the amount of ink stored in the tank 20 is greater than or equal to a predetermined amount, i.e., determines that the tank 20 is not in a near-empty state. In the following description, the state in which the light-blocking portion 25 is in the detection region 29 to block the optical signal is referred to as "light-blocking state".

When the ink level S lowers as a result of ink consumption and reaches and becomes lower than a float-moving level 24*a*, the shutter mechanism 22 starts pivoting. Then, when the light-blocking portion 25 moves out of the detection region 29 in side view, i.e., when the light-blocking portion 25 is no longer overlapped with the detection region 29 in the width direction, the optical signal emitted from the light-emitting portion passes through the detection region 29 and is received by the light-receiving portion. When the light-receiving portion of the optical sensor 12 receives the optical signal in this manner, more specifically, when the light-receiving portion of the optical sensor 12 receives the optical signal having an intensity greater than or equal to a predetermined intensity, the printer main body 1*a* determines that the amount of in stored in the tank 20 is close to zero, i.e., determines that the tank 20 is in the near-empty state. In the following description, the state in which the light-blocking portion 25 is out of the detection region 29 so as not to block the optical signal is referred to as "non-light-blocking state". The specific gravity of the float 24 is set such that the float-moving level 24*a* comes to a position at a height H2 from the bottom surface 20*a* of the tank 20 as shown in FIG. 2A.

Subsequently the large-capacity cartridge 10B according to the first embodiment shown in FIG. 2B will be descried. In the following description, elements of the large-capacity cartridge 10B different from those of the small-capacity cartridge 10A are mainly described, and elements which are common between the small-capacity cartridge 10A and the large-capacity cartridge 10B are designated by common reference numerals and detailed description thereof is omitted.

The cartridge 10B comprises a tank 30 having the same height (dimension in the vertical direction) and width (in the horizontal direction perpendicular to the front-and-rear direction) as those of the tank 20 of the cartridge 10A, but having a depth which is greater than that of the tank 20 of the cartridge 10A in the front-and-rear direction. Therefore, the tank 30 has a larger ink-capacity than the tank 20, i.e., is configured to store a larger amount of ink. The tank 30 comprises an inclined surface 30*b* positioned at a rear portion of an inner bottom surface of the tank 30, and the inclined surface 30*b* is inclined downward and toward the front side of the tank 30, such that the ink flows toward the front side of the tank 30 along the inclined surface 30*b* and reaches the ink supply unit 21 even when a remaining amount of ink stored in the tank 30 is reduced. However, the inclination of the inclined surface 30*b* is gentler than that of the inclined surface 20*b* of the cartridge 10A, i.e., an angle formed between the inclined surface 30*b* and a horizontal surface is smaller than an angle formed between the inclined surface 20*b* and a horizontal surface. Because the depth dimension of the tank 30 in the front-and-rear direction is greater than the depth dimension of the tank 20 in the front-and-rear direction, and the inclined surface 30*b* is gentler than the inclined surface 20*b*, even when the ink level S in the tank 30 is at the same level as the ink level S in the tank 20, a larger amount of ink remains in the tank 30 than in the tank 20.

The cartridge 10B comprises a shutter mechanism 32 in the tank 30, and the shutter mechanism 32 comprises the arm 23, the light-blocking portion 25, and the pivot portion 26, similarly to the shutter mechanism 22. However, the shutter mechanism 32 comprises, in stead of the float 24 of the cartridge 10A, a float 34 having a hollow portion 34*b* formed therein, and therefore the float 34 has a smaller specific gravity than that of the float 24 of the cartridge 10A. Consequently, as shown in FIG. 2A and FIG. 2B, a float-moving level 34*a* is lower than the float-moving level 24*a*. The shutter mechanism 32 starts pivoting when the ink level S in the tank 30 reaches and becomes lower than the float-moving level 34*a*. The shutter mechanism 22 starts pivoting when the ink level S in the tank 20 reaches and becomes lower than the float-moving level 24*a*. The specific gravity of the float 34 is set such that the float-moving level 34*a* comes to a position at a height H3 (<H2) from an outer bottom surface 30*a* of the tank 30.

The structures and arrangements of the locking strip 27 and the stopper 28 provided in the cartridge 10B are the same as those of the cartridge 10A, and the detection region 29 is also set to be at the height H1, similarly to that of the cartridge 10A.

Figure 3:
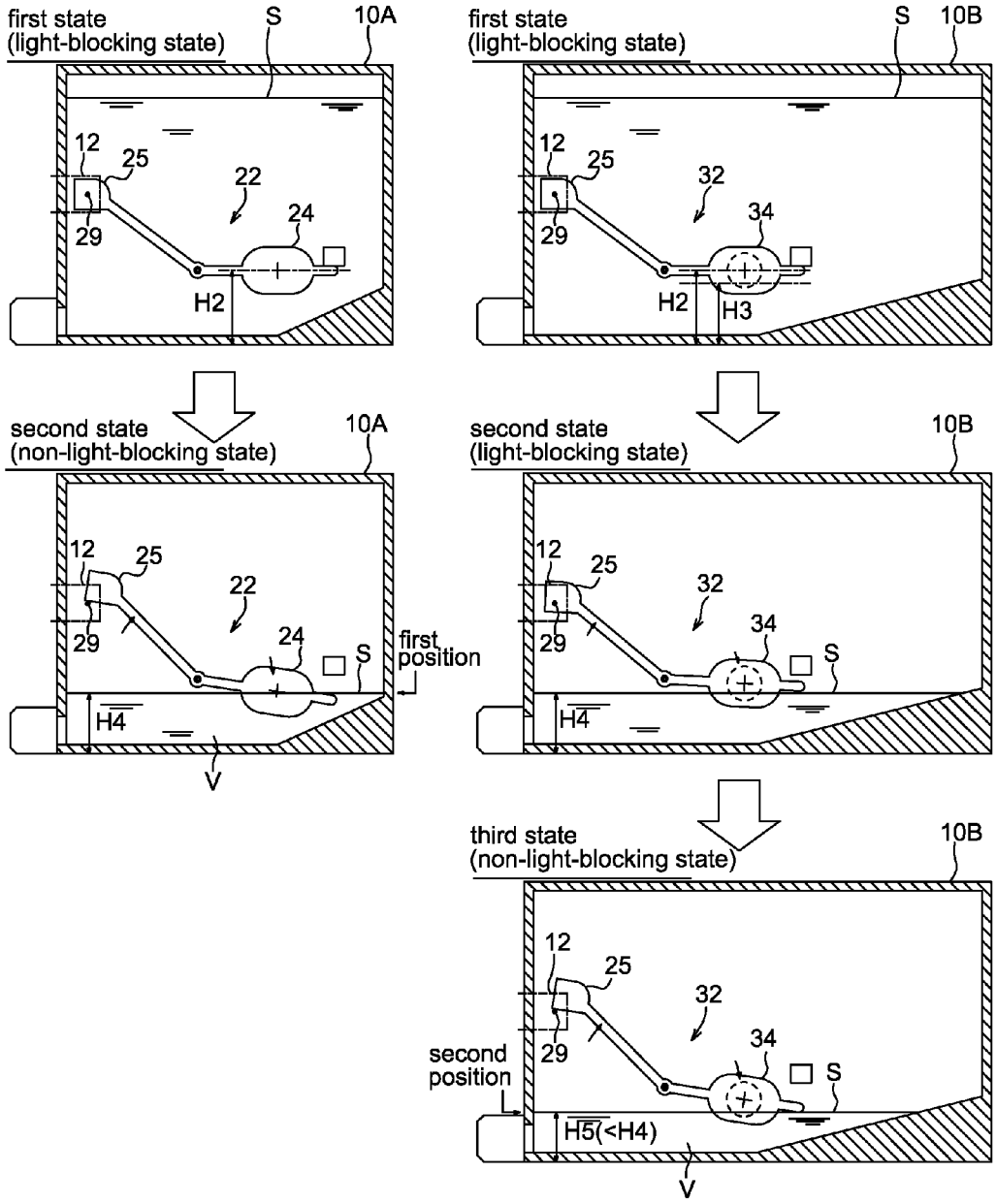
FIG. 3 are cross-sectional side views of the cartridges of FIGS. 2A and 2B for explaining how near-empty states of the cartridges are detected as a result of ink consumption.

The cartridges 10A and 10B according to the first embodiment described above are configured such that when the ink is consumed, the amount of ink stored in the tank 20 when the near-empty state of the tank 20 is detected is the same as the amount of ink stored in the tank 30 when the near-empty state of tank 30 is detected. In FIG. 3, heights H4 and H5 of the ink level S from the outer bottom surfaces 20*a* and 30*a* of the tanks 20 and 30 are shown. In the first embodiment, the specific gravities of the floats 24 and 34, the dimensions of the tanks 20 and 30, etc. are set such that the heights satisfy a relationship H2>H3>H4>H5.

Hereinafter, the terms "first state", "second state", and "third state" indicate states of the ink cartridges 10 having different remaining amounts of ink. First, the small-capacity cartridge 10A shown on the left side in FIG. 3 will be described. As shown in an upper drawing on the left side in FIG. 3, when the ink cartridge 10A is in the first state, the ink level S of ink is positioned above the shutter mechanism 22, and the float 24 is at the upper limit position, and the light-blocking portion 25 is positioned in the detection region 29, i.e., the light-blocking portion 25 is in the light-blocking state. Therefore, the optical signal emitted from the light-emitting portion of the optical sensor 12 is blocked by the light-blocking portion 25, and hence is not received by the light-receiving portion of the optical sensor 12. Therefore, the printer main body 1*a* determines that the tank 20 is not in the near-empty state.

Subsequently, when the ink is consumed and the ink level S reaches the float-moving level 24*a* (height H2), the shutter mechanism 22 starts pivoting in association with lowering of the ink level S, and the light-blocking portion 25 starts moving upward. Then, as shown in a lower drawing on the left side in FIG. 3, when the ink cartridge 10A becomes the second state, the ink level S reaches a first position at the height H4 from the outer bottom surface 20*a* of the tank 20, which height H4 is further downward of the height H2 of the float-moving level 24*a*. When this occurs, the light-blocking portion 25 moves out of the detection region 29 in side view, that is, the light-blocking portion 25 is no longer overlapped with the detection region 29 in the width direction, and is brought into the non-light-blocking state. Because the optical signal emitted from the light-emitting portion is received by the light-receiving portion of the optical sensor 12, the printer main body 1*a* detects the near-empty state of the tank 20. In this manner, in the cartridge 10A, the light-blocking portion 25 is brought into the non-light-blocking state when the ink level S reaches the first position having the height H4 and the near-empty state of the tank 20 is detected. The remaining amount of ink at this time has a volume V.

Next, the large-capacity cartridge 10B shown on the right side in FIG. 3 will be described. As shown in an upper drawing on the right side in FIG. 3, when the cartridge 108 is in the first state, the ink level S of ink is positioned above the shutter mechanism 32, and the light-blocking portion 25 is in the light-blocking state. Therefore, the optical signal emitted from the light-emitting portion of the optical sensor 12 is blocked by the light-blocking portion 25, and hence is not received by the light-receiving portion of the optical sensor 12. The tank 30 is determined not to be in the near-empty state. Even when the ink is consumed and the ink level S reaches the same level as the float-moving level 24*a* of the shutter mechanism 22 of the cartridge 10A, the shutter mechanism 32 does not pivot, and when the ink level S reaches the float-moving level 34*a* (height H3) which is below the float-moving level 24*a*, the shutter mechanism 32 starts pivoting, and the light-blocking portion 25 starts moving upward.

Therefore, in the cartridge 10B, as shown in a middle drawing on the right side in FIG. 3, when the cartridge 10B becomes the second state, i.e., when the ink level S lowers and reaches the height H4 (a height of the ink level where the light-blocking portion 25 of the cartridge 10A is brought into the non-light-blocking state), the light-blocking portion 25 is displaced upward from the position at which the light-blocking portion 25 is positioned when the cartridge 10B is in the first state, but is still in the detection region 29 and is overlapped with the detection region 29 in side view, i.e., in the width direction, such that the optical signal is not received by the light-receiving portion.

When the ink level S is further lowered and, as shown in a lower drawing on the right side in FIG. 3, reaches a second position at the height H5 (<H4), the cartridge 10B becomes the third state, and the light-blocking portion 25 moves out of the detection region 29 in side view, that is, the light-blocking portion 25 is no longer overlapped with the detection region 29 in the width direction, and is bought into the non-light-blocking state. Because the optical signal emitted from the light-emitting portion is received by the light-receiving portion of the optical sensor 12, the printer main body 1*a* detects the near-empty state of the tank 30. In this manner, in the cartridge 10B, the light-blocking portion 25 is brought into the non-light-blocking state when the ink level S reaches the second position having the height H5 and the near-empty state of the tank 30 is detected. The remaining amount of ink at this time has the volume V as in the case of the cartridge 10A.

As described above, in the first embodiment, the shutter mechanism 32 of the large-capacity cartridge 10B starts pivoting when the ink level S reaches the float-moving level 34*a* which is lower than the float-moving level 24*a* at which the ink level S is positioned when the shutter mechanism 22 of the small-capacity cartridge 10A starts pivoting. Moreover, the light-blocking portion 25 of the large-capacity cartridge 10B changes from the light-blocking state to the non-light-blocking state when the ink level S reaches the second position which is lower than the first position at which the ink level S is positioned when the light-blocking portion 25 of the small-capacity cartridge 10A changes from the light-blocking state to the non-light-blocking state. Furthermore, by setting the specific gravities of the floats 24 and 34 adequately, the remaining amounts of ink at the time when the light-blocking portion 25 changes from the light-blocking state to the non-light-blocking state become the same volume V both in the cartridges 10A and 10B. Therefore, the near-empty state of the tank 20 or 30 can be detected with the same remaining amount of ink stored in the tank 20 or 30, even when either of the cartridges 10A and 10B having different volumes is mounted in the cartridge mounting portion 8, without changing the configuration of the printer main body 1*a*.

Figure 4:
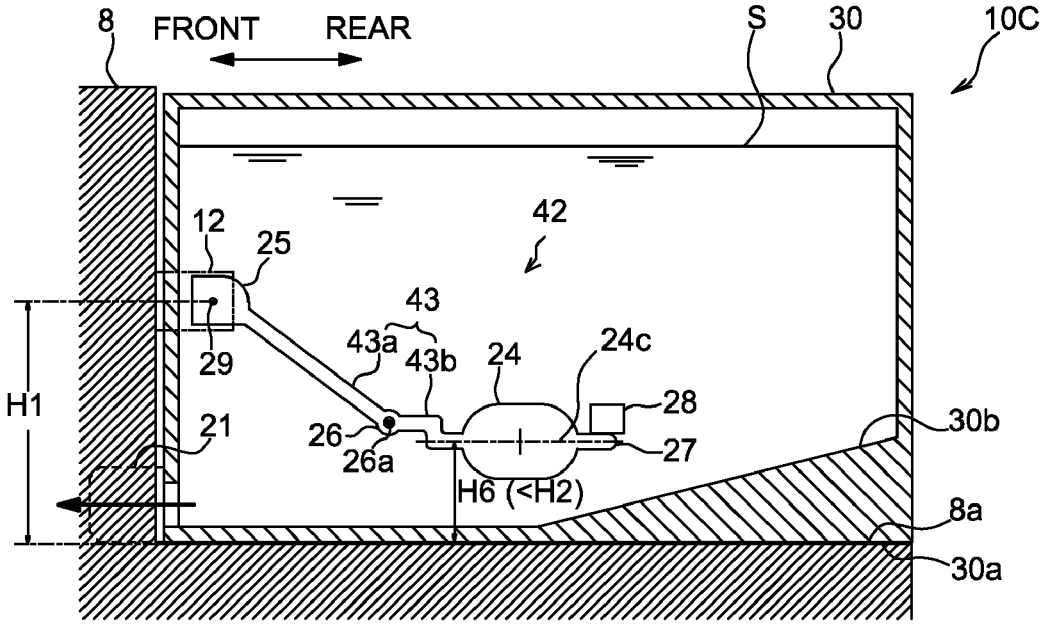
FIG. 4 is a cross-sectional side view of a large-capacity cartridge according to a second embodiment of the invention, which is mounted in the cartridge mounting portion, in which this cartridge according to the second embodiment is used in stead of the large-capacity cartridge according to the first embodiment FIG. 5 are cross-sectional side views of the cartridge of FIG. 2A according to the first embodiment and the cartridge of FIG. 4 according to the second embodiment for explaining how near-empty state of the cartridges are detected as a result of ink consumption.
Figure 5:
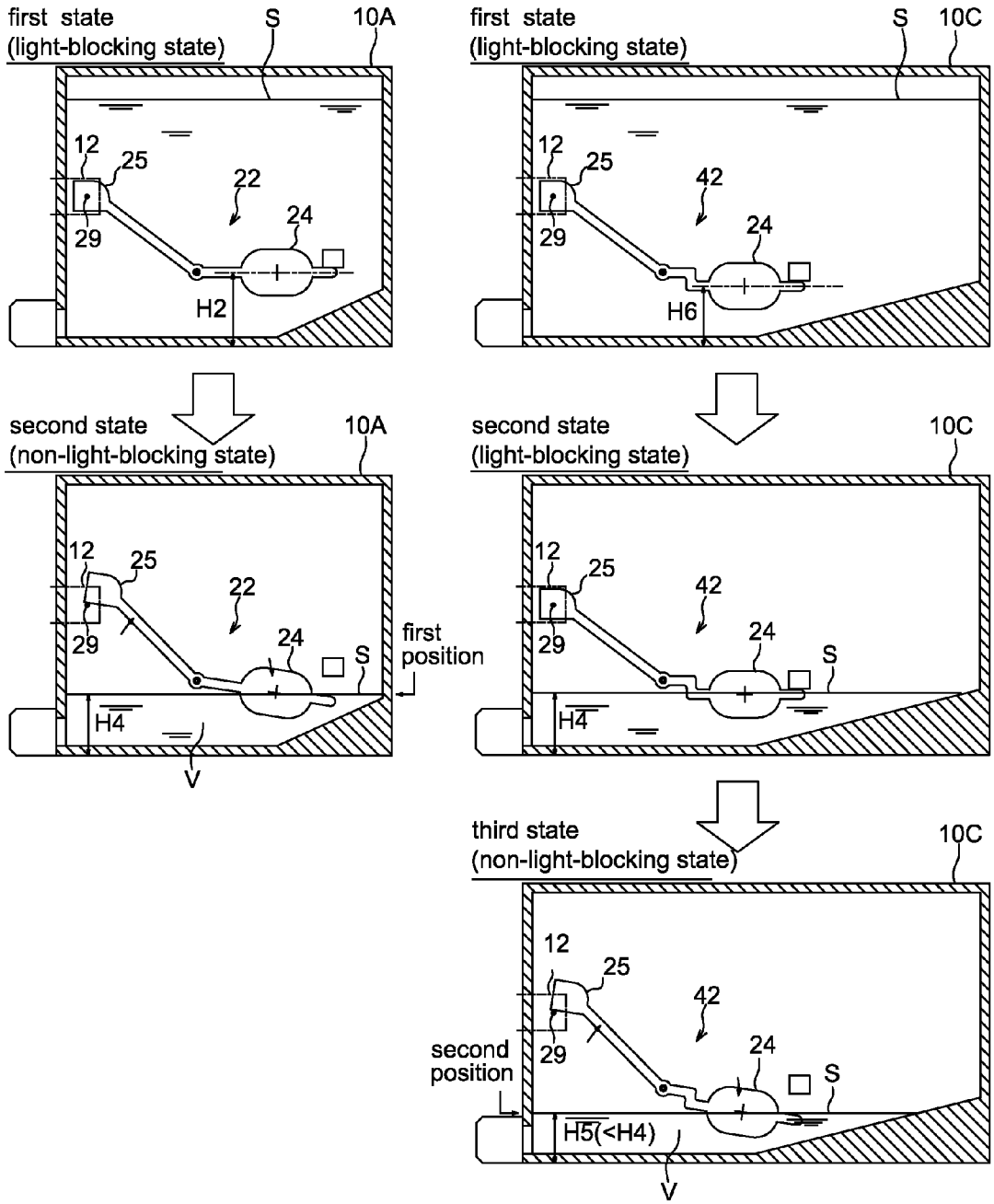

Referring to FIGS. 4 and 5, a large-capacity cartridge 10C according to a second embodiment, which is used in stead of the large-capacity cartridge 10B according to the first embodiment, will be described. The cross-sectional side views of the cartridge 10A shown on the left side in FIG. 5 are the same as the cross-sectional side views of the cartridge 10A shown on the left side in FIG. 3 already described. In FIG. 4 and FIG. 5, elements of the cartridge 10C which are the same as those of the cartridges 10A and 10B are designated by the same reference numerals, and detailed description thereof is omitted.

As shown in FIG. 4, the large-capacity cartridge 10C according to the second embodiment comprises a shutter mechanism 42 in the tank 30. The shutter mechanism 42 comprises the float 24, the light-blocking portion 25, and the pivot portion 26 having the same configurations as those in the small-capacity cartridge 10A described above, but comprises an arm 43 having a different configuration than the arm 23. More specifically, the arm 43 comprises a front arm 43*a* supporting the light-blocking portion 25 at a front end thereof and a rear arm 43*b* supporting the float 24 at a rear end thereof. The front arm 43*a* has the same configuration as the front arm 23*a* of the cartridge 10A, but the rear arm 43*b* is bent downward at a midpoint thereof into a crank shape. In other words, the rear arm 43*b* extends rearward from the pivot portion 26, extends downward, and then extends rearward again.

Therefore, as shown in FIG. 4, when the light-blocking portion 25 of the cartridge 10C is positioned at the same level as the light-blocking portion 25 of the cartridge 10A in the state shown in FIG. 2, the float 24 of the cartridge 10C is positioned lower than the float 24 of the cartridge 10A. The stopper 28 of the cartridge 10C is positioned lower than the stopper 28 of the cartridge 10A such that this position of the float 24 of the cartridge 10C becomes the upper limit position of the movable range of the float 24. The shape of the rear arm 43*b* is set such that the shutter mechanism 42 of the cartridge 10C starts pivoting when the ink level S lowers and reaches a float-moving level 24*c*. The float-moving level 24*c* is positioned at a height H6 from the outer bottom surface 30*a* of the tank 30, and the height H6 is lower than the height H2 (see FIG. 2) of the float-moving level 24*a* at the which the ink level S is positioned when the shutter mechanism 22 of the cartridge 10A starts pivoting.

Referring to FIGS. 4 and 5, the shapes of the shutter mechanisms 22 and 42, the dimensions of the tanks 20 and 30, etc. are set such that the heights of the ink level S shown in FIG. 4 and FIG. 5 have a relationship of H2>H4>H6>H5 in the second embodiment.

As shown in an upper drawing on the right side in FIG. 5, when the cartridge 10C is in the first state, the ink level S is positioned above the shutter mechanism 42, and the light-blocking portion 25 is in the light-blocking state. Therefore, the optical signal emitted from the light-emitting portion of the optical sensor 12 is blocked by the light-blocking portion 25, and hence is not received by the light-receiving portion of the optical sensor 12. When the ink is consumed and the ink level S reaches the height H4 such that the cartridge 10A becomes the second state, the light-blocking portion 25 of the cartridge 10A is brought into the non-light-blocking state already described above.

In contrast, in the cartridge 10C, the height H4 of the ink level S is positioned above the float-moving level 24*c*, the shutter mechanism 42 does not pivot yet (see the "second state" of the cartridge 10C shown on the right side in FIG. 5). Then, when the ink level S further lowers and reaches the height H6, the shutter mechanism 42 starts pivoting and the light-blocking portion 25 starts moving upward.

In this manner, the shutter mechanism 42 of the cartridge 10C starts pivoting after the ink level S has reached a position (height H6) which is lower than the position having height H2. Therefore, as shown in a middle drawing on the right side in FIG. 5, when the cartridge 10C becomes the second state, i.e., when the ink level S lowers and reaches the height H4 (the height of the ink level S when the light-blocking portion 25 of the cartridge 10A is brought into the non-light-blocking state), the light-blocking portion 25 is still in the detection region 29 and is overlapped with the detection region 29 in side view, i.e., in the width direction, such that the optical signal is not received by the light-receiving portion.

When the ink level S further lowers and, as shown in a lower drawing on the right side in FIG. 5, reaches the second position at the height H5 (<H4), the cartridge 10C becomes the third state, and the light-blocking portion 25 moves out of the detection region 29 in side view, that is, the light-blocking portion 25 is no longer overlapped with the detection region 29 in the width direction, and is bought into the non-light-blocking state. Because the optical signal emitted from the light-emitting portion is received by the light-receiving portion of the optical sensor 12, the printer main body 1*a* detects the near-empty state of the tank 30. In this manner, in the cartridge 10C as well, the light-blocking portion 25 is brought into the non-light-blocking state when the ink level S reaches the second position having the height H5 and the near-empty state of the tank 30 is detected. The remaining amount of ink at this time has the same volume V as in the case of the cartridge 10A.

As described above, in the second embodiment, the shutter mechanism 42 of the large-capacity cartridge 10C starts pivoting when the ink level S reaches the float-moving level 24*c* which is lower than the float-moving level 24*a* at which the ink level S is positioned when the shutter mechanism 22 of the small-capacity cartridge 10A starts pivoting. Moreover, the light-blocking portion 25 of the large-capacity cartridge 10C changes from the light-blocking state to the non-light-blocking state when the ink level S reaches the second position having the height H5 which is lower than the first position having the height H4 at which the ink level S is positioned when the light-blocking portion 25 of the small-capacity cartridge 10A changes from the light-blocking state to the non-light-blocking state. Furthermore, by adequately setting a relative height between the upper limit position of the float 24 of the cartridge 10A and the upper limit position of the float 24 of 10C, the remaining amounts of ink at the time when the light-blocking portion 25 changes from the light-blocking state to the non-light-blocking state become the same volume V both in the cartridges 10A and 10C.

Figure 6A:
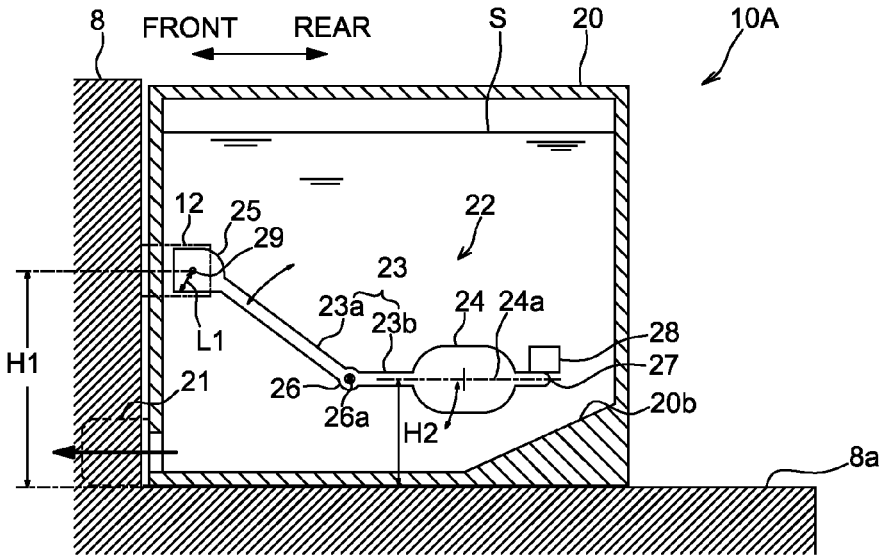
FIG. 6A is the cross-sectional side view of the small-capacity cartridge of FIG. 2A mounted in the cartridge mounting portion according to the first embodiment.
Figure 6B:
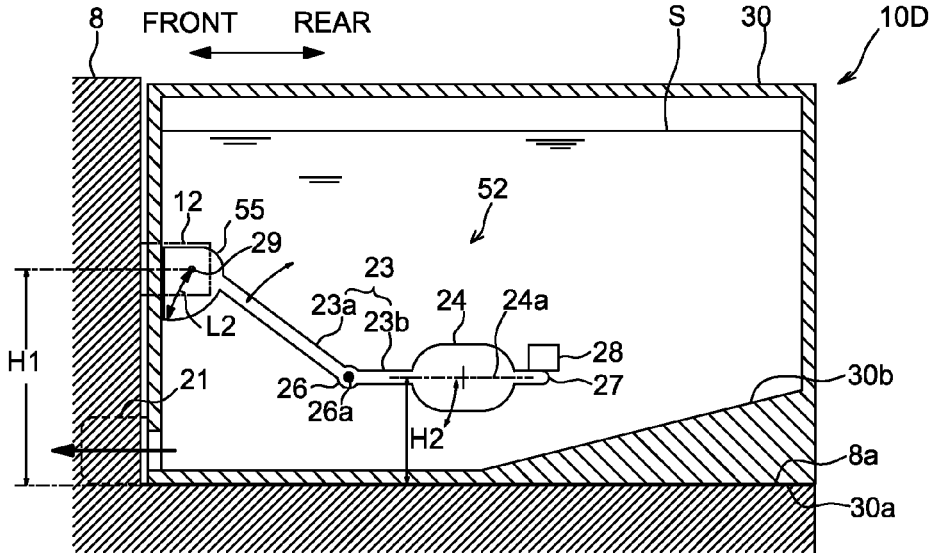
FIG. 6B is a cross-sectional side view of a large-capacity cartridge according to a third embodiment of the invention, which is mounted in the cartridge mounting portion, in which this cartridge according to the third embodiment is used in stead of the large-capacity cartridge according to the first embodiment.
Figure 7:
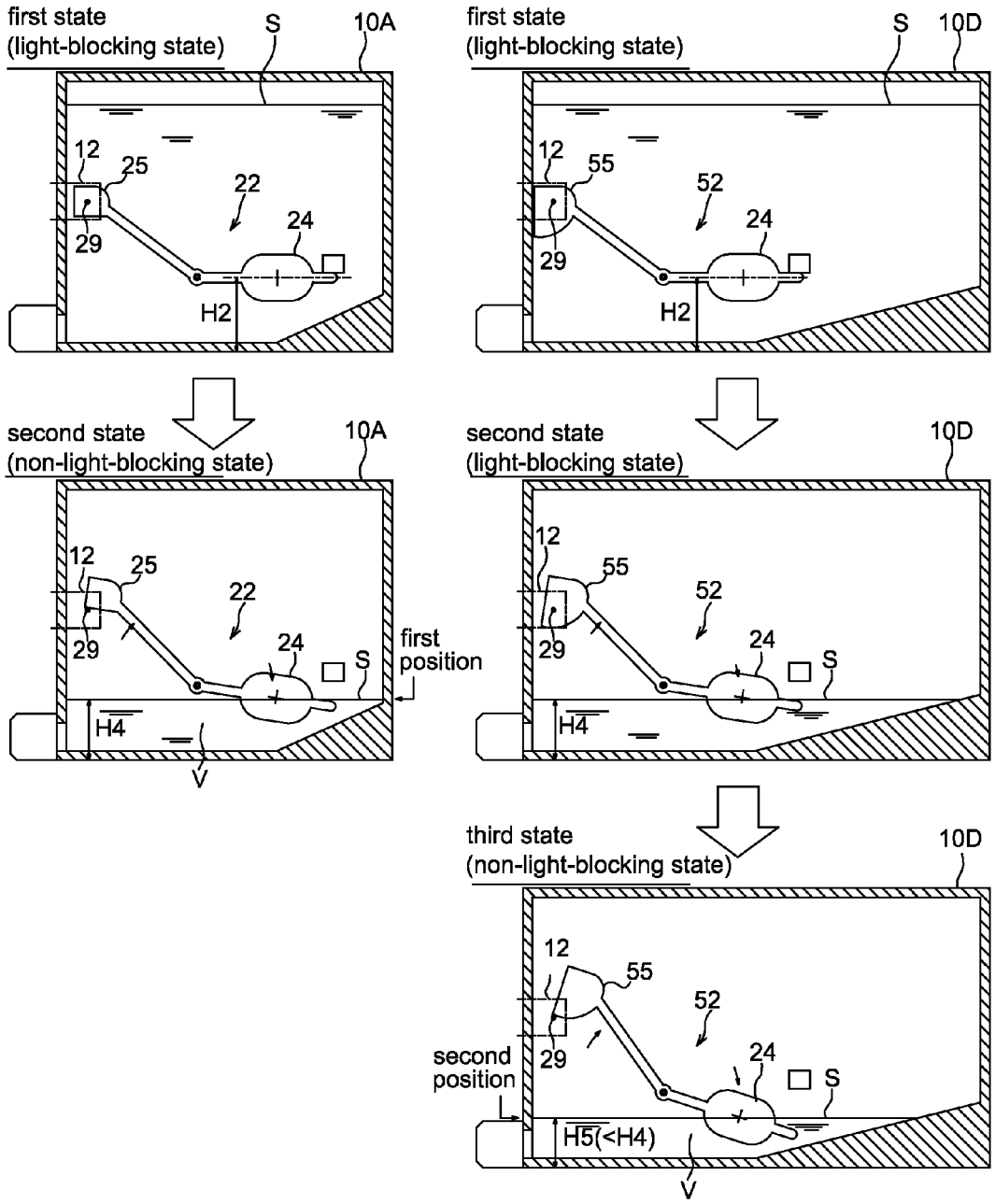
FIG. 7 are cross-sectional side views of the cartridge of FIG. 2A according to the first embodiment and the cartridge of FIG. 6B according to the third embodiment for explaining how near-empty state of the cartridges are detected as a result of ink consumption.

Referring to FIGS. 6 and 7, a large-capacity cartridge 10D according to a third embodiment, which is used in stead of the large-capacity cartridge 10B according to the first embodiment, will be described. The cross-sectional side view of the cartridge 10A shown in FIG. 6A is the same as the cross-sectional side view of the cartridge 10A shown in FIG. 2A, and the cross-sectional side views of the cartridge 10A shown on the left side in FIG. 7 are the same as the cross-sectional side views of the cartridge 10A shown on the left side in FIG. 3 already described. In FIG. 6A, FIG. 6B, and FIG. 7, elements of the cartridge 10D which are the same as those of the cartridges 10A, 10B, and 10C are designated by the same reference numerals, and detailed description thereof is omitted.

As shown in FIG. 6B, the large-capacity cartridge 10D according to the third embodiment comprises a shutter mechanism 52 in the tank 30. The shutter mechanism 52 comprises the arm 23, the float 24, and the pivot portion 26 having the same configurations as those in the small-capacity cartridge 10A described above, but comprises a light-blocking portion 55 having a different configuration than the light-blocking portion 25 of the cartridge 10A. More specifically, as shown in FIG. 6A, a dimension of the light-blocking portion 25 of the cartridge 10A in a moving direction along which the light-blocking portion 25 moves is L1, while the light-blocking portion 55 of the cartridge 10D shown in FIG. 6B has a larger dimension L2 (>L1) in a moving direction along which the light-blocking portion 55 moves.

Here, the expression "the dimension in the moving direction" of the light-blocking portion 25 or 55 described above means a dimension of the light-blocking portion 25 or 55 in a direction along which the light-blocking portion 25 or 55 moves toward or away from the detection region 29. In other words, "the dimension in the moving direction" of the light-blocking portion 25 or 55 corresponds to a length of trajectory of a point overlapping with the detection region 29 in side view (i.e., in the width direction) within the light-blocking portion 25 or 55 when the light-blocking portion 25 or 55 moves. Because the light-blocking portions 25 and 55 pivot about the pivot point 26*a*, such a trajectory is an arcuate shape about the pivot point 26*a* as the center.

As shown in an upper drawing on the right side in FIG. 7, when the cartridge 10D is in the first state, the ink level S is positioned above the shutter mechanism 52, and the light-blocking portion 55 is in the light-blocking state. Therefore, the optical signal emitted from the light-emitting portion of the optical sensor 12 is blocked by the light-blocking portion 55, and hence is not received by the light-receiving portion of the optical sensor 12. When the ink is consumed and the ink level S reaches the height H4 such that the cartridge 10A becomes the second state, the light-blocking portion 25 of the cartridge 10A is brought into the non-light-blocking state as already described above. In contrast, in the cartridge 10D, when the cartridge 10D is in the second state in which the ink level S is at the height H4, the front arm 23*a* of the cartridge 10D has been pivoted upward by the same angle as the front arm 23*a* of the cartridge 10A which is in the second state. However, because the dimension L2 of the light-blocking portion 55 in the moving direction is larger than the dimension L1 of the light-blocking portion 25 in the moving direction, the light-blocking portion 55 is still in the detection region 29 and is overlapped with the detection region 29 in side view (i.e., in the width direction). Therefore, the optical signal is not received by the light-receiving portion.

When the ink level S further lowers and, as shown in a lower drawing on the right side in FIG. 7, reaches the second position at the height H5 (<H4), the cartridge 10D becomes the third state, and the light-blocking portion 55 moves out of the detection region 29 in side view, that is, the light-blocking portion 55 is no longer overlapped with the detection region 29 in the width direction, and is bought into the non-light-blocking state. Because the optical signal emitted from the light-emitting portion is received by the light-receiving portion of the optical sensor 12, the printer main body 1*a* detects the near-empty state of the tank 30. In this manner, in the cartridge 10D, the light-blocking portion 55 is brought into the non-light-blocking state when the ink level S reaches the second position having the height H5 and the near-empty state of the tank 30 is detected. The remaining amount of ink at this time has the same volume V as in the case of the cartridge 10A.

As described above, in the third embodiment, although the float-moving level 24*a* at which the ink level S is positioned when the shutter mechanisms 22 and 52 start moving is the same in the cartridges 10A and 10D, the light-blocking portion 55 of the cartridge 10D is positioned in the detection region 29 longer than the light-blocking portion 25 of the cartridge 10A until the ink level S further lowers because of the difference in dimensions of the light-blocking portions 25 and 55 in the moving direction. In other words, when the ink level S lowers at a predetermined speed, the period of time required from when the shutter mechanisms 22 and 52 start pivoting to when the state of the light-blocking portions 25 and 55 become the non-light-blocking state is longer in the cartridge 10D than in the cartridge 10A. Then, by adequately setting the dimensions L1 and L2 of the light-blocking portions 25 and 55, the remaining amounts of ink at the time when the light-blocking portions 25 and 55 changes from the light-blocking state to the non-light-blocking state become the same volume V both in the cartridges 10A and 10D.

Figure 8A:
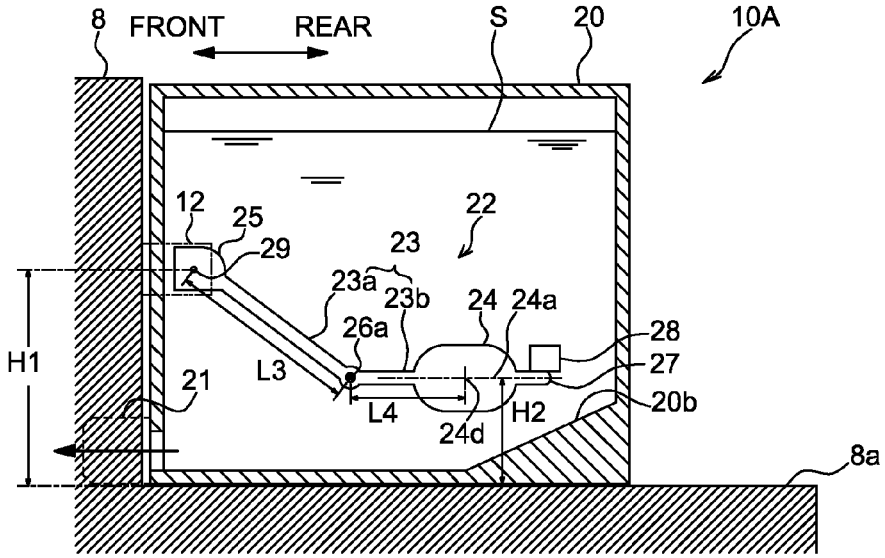
FIG. 8A is the cross-sectional side view of the small-capacity cartridge of FIG. 2A mounted in the cartridge mounting portion according to the first embodiment.
Figure 8B:
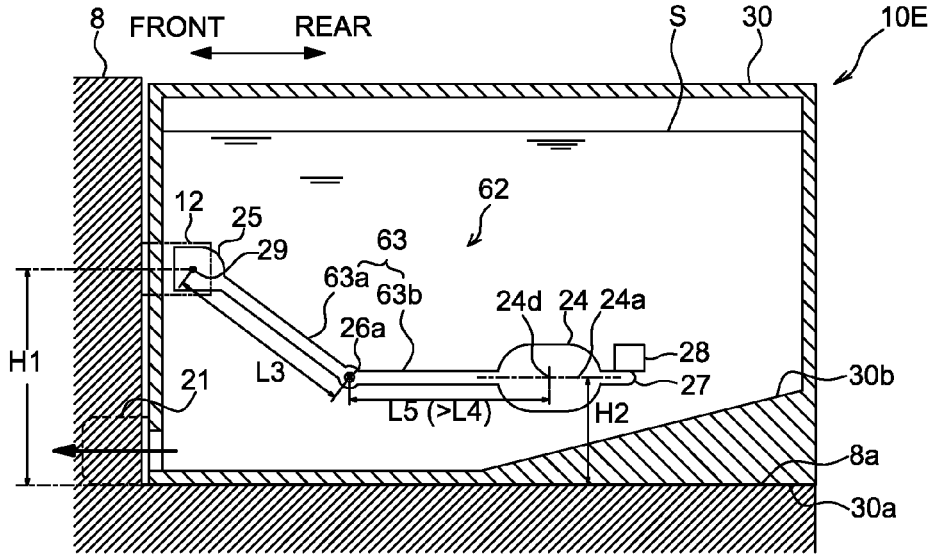
FIG. 8B is a cross-sectional side view of a large-capacity cartridge according to a fourth embodiment of the invention, which is mounted in the cartridge mounting portion, in which this cartridge according to the fourth embodiment is used in stead of the large-capacity cartridge according to the first embodiment.
Figure 9:
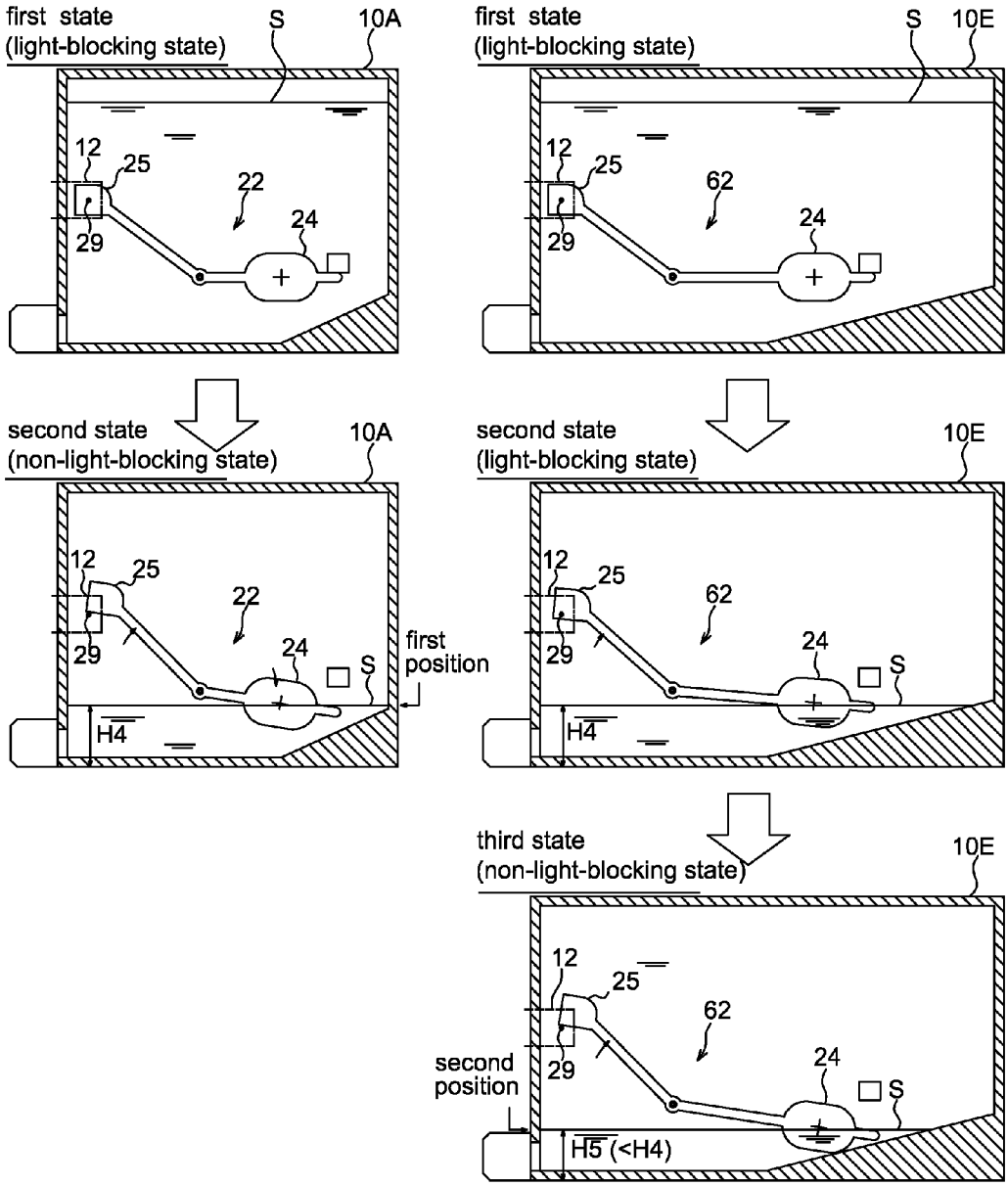
FIG. 9 are cross-sectional side views of the cartridge of FIG. 2A according to the first embodiment and the cartridge of FIG. 8B according to the fourth embodiment for explaining how near-empty state of the cartridges are detected as a result of ink consumption.

Referring to FIGS. 8 and 9, a large-capacity cartridge 10E according to a fourth embodiment, which is used in stead of the large-capacity cartridge 10B according to the first embodiment, will be described. The cross-sectional side view of the cartridge 10A shown in FIG. 8A is the same as the cross-sectional side view of the cartridge 10A shown in FIG. 2A, and the cross-sectional side views of the cartridge 10A shown on the left side in FIG. 9 is the same as the cross-sectional side views of the cartridge 10A shown on the left side in FIG. 3 already described. In FIG. 8A, FIG. 8B, and FIG. 9, elements of the cartridge 10E which are the same as those of the cartridges 10A to 10D are designated by the same reference numerals, and detailed description thereof is omitted.

As shown in FIG. 8B, the large-capacity cartridge 10E according to the fourth embodiment comprises a shutter mechanism 62 in the tank 30. The shutter mechanism 62 comprises the float 24, the light-blocking portion 25, and the pivot portion 26 having the same configurations as those in the small-capacity cartridge 10A described above, but comprises an arm 63 having a different configuration than the arm 23 of the cartridge 10A. More specifically, the arm 63 comprises a front arm 63*a* supporting the light-blocking portion 25 at a front end thereof and a rear arm 63*b* supporting the float 24 connected to a rear end thereof. The front arm 63*a* has the same configuration as the front arm 23*a* of the cartridge 10A, and the dimensions of the front arms 23*a* and 63*a* are set such that a distance from the pivot point 26*a* to a portion where the light-blocking portion 25 is overlapped with the detection region 29 in side view (i.e., in the width direction) becomes L3 in a state shown in FIGS. 8A and 8B.

The dimension of the rear arm 23*b* of the cartridge 10A is set such that a distance from the pivot point 26*a* to a center of gravity 24*d* of the float 24 becomes L4, while the dimension of the rear arm 63*b* of the cartridge 10E is set such that a distance from the pivot point 26*a* to the center of gravity 24*d* of the float 24 becomes L5, which is larger than the distance L4. In other words, a ratio L5/13, which is a value calculated by dividing the distance L5 by the distance L3, is greater than a ratio L4/L3, which is a value calculated by dividing the distance L4 by the distance L3.

As shown in an upper drawing on the right side in FIG. 9, when the cartridge 10E is in the first state, the ink level S is positioned above the shutter mechanism 62, and the light-blocking portion 25 is in the light-blocking state. Therefore, the optical signal emitted from the light-emitting portion of the optical sensor 12 is blocked by the light-blocking portion 25, and hence is not received by the light-receiving portion of the optical sensor 12. When the ink is consumed and the ink level S reaches the height H4 such that the cartridge 10A becomes the second state, the light-blocking portion 25 of the cartridge 10A is brought into the non-light-blocking state already described above. In contrast, because the rear 63*b* of the cartridge 10E is longer than the rear arm 23*b* of the cartridge 10A, an angle by which the shutter mechanism 62 has pivoted when the cartridge 10E is in the second state is smaller than an angle by which the shutter mechanism 22 has pivoted when the cartridge 10A is in the second state. Therefore, the light-blocking portion 25 of the cartridge 10E is still in the detection region 29, and is overlapped with the detection region 29 in side view (i.e., in the width direction), such that the optical signal is not received by the light-receiving portion.

When the ink level S further lowers and, as shown in a lower drawing on the right side in FIG. 9, reaches the second position at the height H5 (<H4), the cartridge 10E becomes the third state, and shutter mechanism 62 moves out of the detection region 29 in side view, that is, the light-blocking portion 25 is no longer overlapped with the detection region 29 in the width direction, and is bought into the non-light-blocking state. Because the optical signal emitted from the light-emitting portion is received by the light-receiving portion of the optical sensor 12, the printer main body 1*a* detects the near-empty state of the tank 30. In this manner, in the cartridge 10E, the light-blocking portion 25 is brought into the non-light-blocking state when the ink level S reaches the second position having the height H5 and the near-empty state of the tank 30 is detected. The remaining amount of ink at this time has the same volume V as in the case of the cartridge 10A.

As described above, in the fourth embodiment, although the float-moving level 24*a* at which the ink level S is positioned when the shutter mechanisms 22 and 62 start pivoting is the same in the cartridges 10A and 10E, the light-blocking portion 25 of the cartridge 10E is positioned in the detection region 29 longer than the light-blocking portion 25 of the cartridge 10A until the ink level S further lowers because of the difference in the lengths between the rear arms 23*b* and 63*b*. In other words, when the ink level S lowers at a predetermined speed, the period of time required from when the shutter mechanisms 22 and 62 start pivoting to when the state of the light-blocking portion 25 becomes the non-light-blocking state is longer in the cartridge 10E than the cartridge 10A. Then, by adequately setting the distances L4 and L5, or by adequately setting the ratios L4/L3, L5/L3, the remaining amounts of ink at the time when the light-blocking portion 25 changes from the light-blocking state to the non-light-blocking state become the same volume V both in the cartridges 10A and 10E.

Referring to FIGS. 10A to 10D, a small-capacity cartridge 110A according to a modified embodiment, a large-capacity cartridge 110B according to the modified embodiment, a large-capacity cartridge 110C according to another modified embodiment, and a large-capacity cartridge 110D according to still another modified embodiment will be described. The small-capacity cartridge 110A constitutes the set of cartridges 1*b* in association with any one of the large-capacity cartridges 110B to 110D.

Figure 10C:
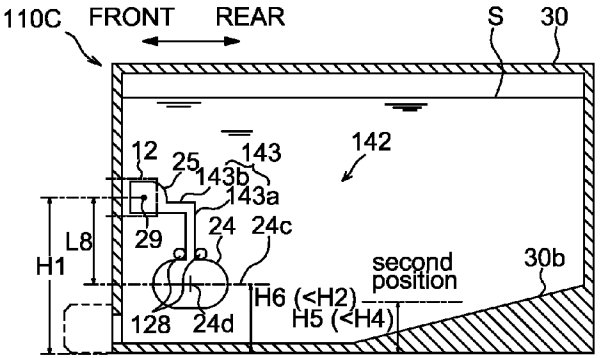
FIG. 10C is a cross-sectional side view of a large-capacity cartridge according to another modified embodiment.
Figure 10D:
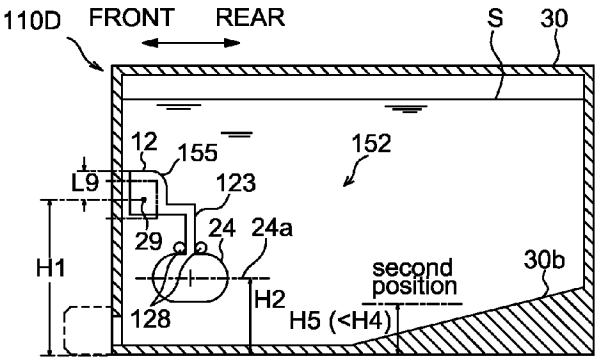
FIG. 10D is a cross-sectional side view of a large-capacity cartridge according to still another modified embodiment.
Figure 10A:
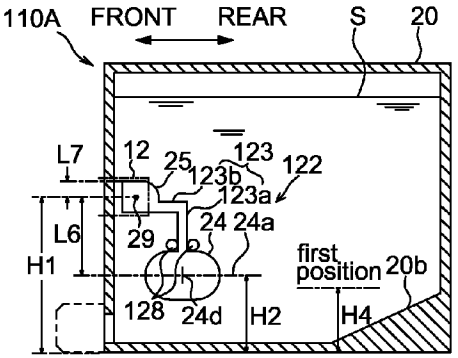
FIG. 10A is a cross-sectional side view of a small-capacity cartridge according to a modified embodiment.

The cartridge 110A shown in FIG. 10A comprises the same tank 20 as in the cartridge 10A shown in FIG. 2A, and comprises a shutter mechanism 122 in the tank 20. The shutter mechanism 122 is not configured to pivot about the pivot point 26*a* like the shutter mechanism 22 already described above, but is configured to move up and down in the vertical direction by being guided by a guide 128 which also serves as a stopper.

More specifically, the shutter mechanism 122 comprises the float 24 and the light-blocking portion 25 having the same configurations as those in the cartridge 10A, but comprises an arm 123 supporting the float 24 and the light-blocking portion 25 at both ends thereof. The arm 123 comprises a vertical portion 123*a* extending vertically upward from the float 24 and a horizontal portion 123*b* extending forward from an upper end of the vertical portion 123*a* to the light-blocking portion 25. The vertical portion 123*a* is sandwiched by the guide 128 from the front and rear. Therefore, the shutter mechanism 122 is configured to be movable up and down in the vertical direction while the vertical portion 123*a* being guided by the guide 128. The upward movement of the shutter mechanism 122 is restricted by an upper end of the float 24 coming into contact with the guide 128 from below.

In the cartridge 110A as described above, the shutter mechanism 122 is at an upper limit position by the buoyancy of the float 24 when the ink cartridge 110A is almost full of ink. Because the light-blocking portion 25 is still in the detection region 29 at this time, the optical signal is not received by the light-receiving portion of the optical sensor 12, i.e., the light-blocking portion 25 is in the light-blocking state. When the ink level S lowers from this state and reaches the height H2 of the float-moving level 24*a*, the shutter mechanism 122 starts moving downward. When the ink level S reaches the first position having the height H4, the light-blocking portion 25 moves out of the detection region 29, and is brought into the non-light-blocking state. The remaining amount of ink when the ink level S has the height H4 has the volume V.

Figure 10B:
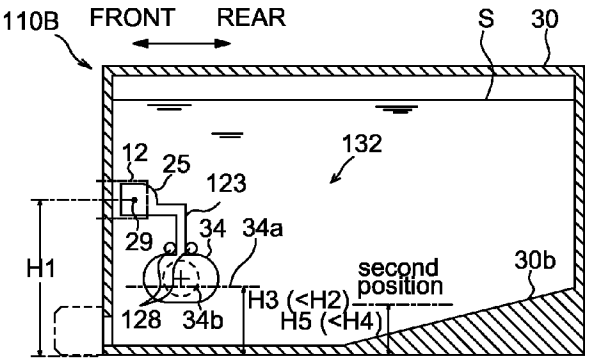
FIG. 10B is a cross-sectional side view of a large-capacity cartridge according to the modified embodiment.

The cartridge 110B shown in FIG. 10B comprises the same tank 30 as in the cartridge 10B shown in FIG. 2B, and comprises a shutter mechanism 132 in the tank 30. The shutter mechanism 132 has the same configuration as the shutter mechanism 122 in most part, but comprises the float 34 instead of the float 24. The float 34 has the same configuration as the float 34 shown in FIG. 2B, and has the hollow portion 34*b* formed therein. Therefore, the float 34 has a smaller specific gravity than the float 24 of the cartridge 110A, and the float-moving level 34*a*, at which the ink level S is positioned when the shutter mechanism 132 starts moving, has the height H3 which is lower than the float-moving level 24*a*, at which the ink level S is positioned when the shutter mechanism 122 starts moving.

In the cartridge 110B, the shutter mechanism 132 is positioned at an upper limit position by the buoyancy of the float 24 when the cartridge 110B is almost full of ink. Because the light-blocking portion 25 is still in the detection region 29 at this time, the optical signal is not received by the light-receiving portion of the optical sensor 12, i.e., the light-blocking portion 25 is in the light-blocking state. When the ink level S lowers from this state and reaches the height H3 of the float-moving level 34*a*, the shutter mechanism 132 starts moving downward. When the ink level S reaches the second position having the height H5 (<H4), the light-blocking portion 25 moves out of the detection region 29, and is brought into the non-light-blocking state. The remaining amount of ink when the ink level S has the height H5 has the volume V.

As described above, the shutter mechanism 132 of the large-capacity cartridge 110B starts moving when the ink level S reaches the float-moving level 34*a* which is lower than the float-moving level 24*a* at which the ink level S is positioned when the shutter mechanism 122 of the small-capacity cartridge 110A starts moving. Moreover, the light-blocking portion 25 of the large-capacity cartridge 110B changes from the light-blocking state to the non-light-blocking state when the ink level S reaches the second position which is lower than the first position at which the ink level S is positioned when the light-blocking portion 25 of the small-capacity cartridge 110A changes from the light-blocking state to the non-light-blocking state. Furthermore, by setting the specific gravities of the floats 24 and 34 adequately, the remaining amounts of ink at the time when the state of the light-blocking portion 25 changes from the light-blocking state to the non-light-blocking state become the same volume V both in the cartridges 110A mid 110B.

The cartridge 110C shown in FIG. 10C comprises a shutter mechanism 142 in the tank 30. The shutter mechanism 142 has the same configuration as the shutter mechanism 122 in most part, but comprises an arm 143 having different configuration from the arm 123. The arm 143 includes a vertical portion 143*a* extending vertically upward from the float 24 and a horizontal portion 143*b* extending forward from an upper end of the vertical portion 143*a* to the light-blocking portion 25. The vertical portion 143*a* is longer than the vertical portion 123*a* of the arm 123 of the cartridge 110A. Therefore, a distance in the vertical direction from the center of gravity 24*d* of the float 24 to a portion where the light-blocking portion 25 is overlapped with the detection region 29 in side view (that is, in the width direction) in a state shown in FIG. 10 is a distance L6 in the cartridge 110A (see FIG. 10A), while the distance is a distance L8, which is longer than L6, in the cartridge 110C.

Because the arm 143 is longer as described above, the guide 128 of the cartridge 110C is positioned lower than the guide 128 of the cartridge 110A by an amount corresponding to the difference (L8–L6) of the arm 123, 143. Therefore, when the shutter mechanisms 122 and 142 are both positioned at the upper limit positions, the position of the light-blocking portion 25 of the shutter mechanism 142 is the same as the position of the light-blocking portion 25 of the shutter mechanism 122, while a float-moving level 24*c*, at which the ink level S is positioned when the shutter mechanism 142 starts moving, has the height H6, which is lower than the height H2 of the float-moving level 24*a*, at which the ink level S is positioned when the shutter mechanism 122 starts moving.

In the cartridge 110C configured as described above, the shutter mechanism 142 is at the upper limit position by the buoyancy of the float 24 when the cartridge 110C is almost full of ink. Because the light-blocking portion 25 is in the detection region 29 at this time, the optical signal is not received by the light-receiving portion of the optical sensor 12, i.e., the light-blocking portion 25 is in the light-blocking state. When the ink level S lowers from this state and reaches the height H6 of the float-moving level 24*c*, which is lower than the height H2, the shutter mechanism 142 starts moving downward. When the ink level S reaches the second position having the height H5 (<H4), the light-blocking portion 25 moves out of the detection region 29, and is brought into the non-light-blocking state. The remaining amount of ink when the ink level S has the height H5 has the volume V.

As described above, the shutter mechanism 142 of the large-capacity cartridge 110C starts pivoting when the ink level S reaches the float-moving level 24*c* which is lower than the float-moving level 24*a* at which the ink level S is positioned when the shutter mechanism 122 of the small-capacity cartridge 110A starts pivoting. Moreover, the light-blocking portion 25 of the large-capacity cartridge 110C changes from the light-blocking state to the non-light-blocking state when the ink level S reaches the second position having the height H5 which is lower than the first position having the height H4 at which the ink level S is positioned when the light-blocking portion 25 of the small-capacity cartridge 110A changes from the light-blocking state to the non-light-blocking state. Furthermore, by adequately setting the length of the arm 143 and the vertical position of the guide 128, the remaining amounts of ink at the time when the light-blocking portion 25 changes from the light-blocking state to the non-light-blocking state become the same volume V both in the cartridges 110A and 110C.

The cartridge 110D shown in FIG. 10D comprises a shutter mechanism 152 in the tank 30. The shutter mechanism 152 has the same configuration as the shutter mechanism 122 in most part, but comprises a light-blocking portion 155 having a larger dimension in a direction along which the light-blocking portion 25 moves. In other words, in the case of the light-blocking portion 25 of the cartridge 110A, the dimension of the light-blocking portion 25 in a direction along which the light-blocking portion 25 moves toward or away from the detection region 29, i.e., a length of trajectory of a point overlapping with the detection region 29 in side view (i.e., in the width direction) within the light-blocking portion 25 when the light-blocking portion 25 moves up and down, is a dimension L7 (see FIG. 10A). In contrast, in the light-blocking portion 155 of the cartridge 110D, the dimension of the light-blocking portion 155 in a direction along which the light-blocking portion 155 moves toward or away from the detection region 29, i.e., a length of trajectory of a point overlapping with the detection region 29 in side view (i.e., in the width direction) within the light-blocking portion 155 when the light-blocking portion 155 moves up and down, is a dimension L9, which is larger than the dimension L7.

in the cartridge 110D configured as described above, the shutter mechanism 152 is at an upper limit position by the buoyancy of the float 24 when the cartridge 110 D is almost full of ink. Because the light-blocking portion 155 is in the detection region 29, the optical signal is not received by the light-receiving portion of the optical sensor 12, i.e., the light-blocking portion 155 is in the light-blocking state. When the ink level S lowers from this state and reaches the height H2 of the float-moving level 24*a*, the shutter mechanism 152 starts moving downward. When the ink level S passes the first position (height H4) and reaches the second position having the height H5, the light-blocking portion 155 moves out of the detection region 29, and is brought into the non-light-blocking state. The remaining amount of ink when the ink level S has the height H5 has the volume V.

As described above, in this case, although the float-moving level 24*a* at which the ink level S is positioned when the shutter mechanisms 122 and 152 start moving downward is the same in the cartridges 110A and 110D, the light-blocking portion 155 of the cartridge 110D is positioned in the detection region 29 longer than the light-blocking portion 25 of the cartridge 10A until the ink level S further lowers because of the difference in dimensions of the light-blocking portions 25 and 155 in the moving direction. Then, by adequately setting the dimensions L7 and L9 of the light-blocking portions 25 and 155, the remaining amounts of ink at the time when the states of the light-blocking portions 25 and 155 change from the light-blocking states to the non-light-blocking states become the same volume V both in the cartridges 110A and 110D.

In the first to fourth embodiments and the modified embodiment, the cartridge is configured to be inserted into and removed from the cartridge mounting portion in a horizontal direction. However, the invention is applicable even when the cartridge is inserted into and removed from the cartridge mounting portion in the vertical direction. In other words, the invention is applicable irrespective of the direction of insertion and removal of the cartridge into/from the cartridge mounting portion.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A set of cartridges comprising:

a first cartridge having a small capacity and comprising a first tank configured to store liquid therein, wherein a liquid level in the first tank is at a first position when an amount of liquid stored in the first tank is a predetermined amount; and a second cartridge having a large capacity and comprising a second tank configured to store liquid therein, wherein the second tank has a larger capacity than the tank of the first cartridge, and a liquid level in the second tank is at a second position which is below the first position when an amount of liquid stored in the second tank is the predetermined amount, wherein each of the first cartridge and the second cartridge comprises:

a detection region configured to receive an optical signal emitted from an exterior of the first tank or the second tank, wherein the detection region of the first cartridge is positioned at a same height as the detection region of the second cartridge;

a float positioned in the first tank or the second tank, and configured to move based on the amount of liquid stored in the first tank or the second tank; and a light-blocking portion connected to the float and configured to move relative to the detection region based on a movement of the float, wherein the light-blocking portion is configured to block the optical signal when the light-blocking portion is in the detection region and the optical signal is allowed to pass through the detection region when the light-blocking portion is out of the detection region, wherein the first cartridge is configured such that the light-blocking portion moves out of the detection region when the liquid level in the first tank lowers and reaches the first position, and the second cartridge is configured such that the light-blocking portion moves out of the detection region when the liquid level in the second tank lowers and reaches the second position.

2. The set of cartridges of claim 1, wherein the light-blocking portion of the first cartridge is configured to start moving to be out of the detection region when the liquid level in the first tank lowers and reaches a third position, and the light-blocking portion of the second cartridge is configured to start moving to be out of the detection region when the liquid level in the second tank lowers and reaches a fourth position, wherein the fourth position is below the third position.

3. The set of cartridges of claim 2, wherein a specific gravity of the float of the second cartridge is less than a specific gravity of the float of the first cartridge.

4. The set of cartridges of claim 2, wherein the float of the second cartridge is positioned lower than the float of the first cartridge when the light-blocking portions of the first cartridge and the second cartridge are in the detection regions of the first cartridge and the second cartridge, respectively.

5. The set of cartridges claim 1, wherein a period of time from when the light-blocking portion of the second cartridge starts to move to be out of the detection region in a state in which the light-blocking portion blocks the optical signal to when the optical signal starts to be allowed to pass through the detection region while the liquid level in the second tank lowers at a predetermined speed is greater than a period of time from when the light-blocking portion of the first cartridge starts to move to be out of the detection region in a state in which the light-blocking portion blocks the optical signal to when the optical signal starts to be allowed to pass through the detection region while the liquid level in the first tank lowers at the predetermined speed.

6. The set of cartridges of claim 5, wherein a dimension of the light-blocking portion of the second cartridge in a direction along which the light-blocking portion of the second cartridge moves relative to the detection region of the second cartridge is greater than a dimension of the light-blocking portion of the first cartridge in a direction along which the light-blocking portion of the first cartridge moves relative to the detection region of the first cartridge.

7. The set of cartridges of claim 5, wherein each of the first cartridge and the second cartridge comprises an arm supporting the float at a first end of the arm and supporting the light-blocking portion at a second end of the arm, wherein the arm comprises a pivot portion between the float and the light-blocking portion, and the pivot portion has a pivot point about which the arm pivots relative to the tank, wherein a value calculated by dividing a distance from the pivot point of the second cartridge to a center of gravity of the float of the second cartridge by a distance from the pivot point of the second cartridge to the detection region of the second cartridge is greater than a value calculated by dividing a distance from the pivot point of the first cartridge to a center of gravity of the float of the first cartridge by a distance from the pivot point of the first cartridge to the detection region of the first cartridge.

8. A printer comprising:

a printer main body comprising:

a cartridge mounting portion configured to selectively receive a plurality of cartridges having different capacities, such that the plurality of cartridges is selectively connected to a same liquid supply path; and an optical detector configured for detecting an amount of liquid stored in a cartridge mounted in the cartridge mounting portion, and the set of cartridges of claim 1, wherein each of the first cartridge and the second cartridge is configured to be mounted to the cartridge mounting portion, such that an optical signal emitted from the optical detector enters the detection region.

9. The set of cartridges of claim 1, wherein the first cartridge and second cartridge are configured to be selectively mounted to the same mounting portion of a printer.

* * * * *